US010700439B2

(12) United States Patent
Zhou et al.

(10) Patent No.: US 10,700,439 B2
(45) Date of Patent: Jun. 30, 2020

(54) PRINTED DIPOLE ANTENNA, ARRAY ANTENNA, AND COMMUNICATIONS DEVICE

(71) Applicant: Huawei Technologies Co., Ltd., Shenzhen (CN)

(72) Inventors: Xiao Zhou, Suzhou (CN); Michael Kadichevitz, Hod Hasharon (IL); Bo Yuan, Suzhou (CN); Xingfeng Jiang, Hod Hasharon (IL)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 82 days.

(21) Appl. No.: 16/172,241

(22) Filed: Oct. 26, 2018

(65) Prior Publication Data

US 2019/0131715 A1 May 2, 2019

(30) Foreign Application Priority Data

Oct. 26, 2017 (CN) ..... 2017 1 1011901

(51) Int. Cl.

| | |
|---|---|
| ***H01Q 1/38*** | (2006.01) |
| ***H01Q 21/06*** | (2006.01) |
| ***H01Q 9/06*** | (2006.01) |
| ***H01Q 21/00*** | (2006.01) |
| ***H01Q 5/35*** | (2015.01) |
| ***H01Q 21/12*** | (2006.01) |

(52) U.S. Cl.

CPC ..... *H01Q 21/062* (2013.01); *H01Q 1/38* (2013.01); *H01Q 5/35* (2015.01); *H01Q 9/065* (2013.01); *H01Q 21/0006* (2013.01); *H01Q 21/0025* (2013.01); *H01Q 21/0087* (2013.01); *H01Q 21/12* (2013.01)

(58) Field of Classification Search

CPC ..... H01Q 21/062; H01Q 5/35; H01Q 1/38; H01Q 21/0006; H01Q 21/0025; H01Q 21/0087

See application file for complete search history.

(56) References Cited

U.S. PATENT DOCUMENTS 6,285,323 B1 9/2001 Frank
6,831,602 B2 12/2004 McKinzie, III et al.
(Continued)

FOREIGN PATENT DOCUMENTS

CN 101849318 A 9/2010
CN 101997170 A 3/2011
(Continued)

OTHER PUBLICATIONS

Foreign Communication From a Counterpart Application, European Application No. 18202719.3, Extended European Search Report dated Mar. 13, 2019, 11 pages.
(Continued)

*Primary Examiner* — Graham P Smith
(74) *Attorney, Agent, or Firm* — Conley Rose, P.C.

(57) ABSTRACT

A printed dipole antenna includes a first printed dipole, a second printed dipole, a third printed dipole, a fourth printed dipole, a first feed line, a second feed line, a third feed line, and a fourth feed line. Feed lines parallel to the printed dipoles each include different segments, and each segment approaches a printed dipole on one side of the segment to suppress parasitic emission of the feed lines, and implement a low sidelobe level of the printed dipole antenna.

20 Claims, 8 Drawing Sheets

(56) References Cited

U.S. PATENT DOCUMENTS

| | | | |
|---|---|---|---|
| 8,200,168 | B2 | 6/2012 | Rofougaran et al. |
| 2003/0016097 | A1 | 1/2003 | McKinzie, III et al. |
| 2009/0122847 | A1 | 5/2009 | Nysen |
| 2010/0277374 | A1 | 11/2010 | Ju et al. |

FOREIGN PATENT DOCUMENTS

| | | | |
|---|---|---|---|
| CN | 102868020 | A | 1/2013 |
| WO | 2013089456 | A1 | 6/2013 |

OTHER PUBLICATIONS

Machine Translation and Abstract of Chinese Publication No. CN101997170, Mar. 30, 2011, 7 pages.
Machine Translation and Abstract of Chinese Publication No. CN102868020, Jan. 9, 2013, 12 pages.
Machine Translation and Abstract of International Publication No. WO2013089456, Jun. 20, 2013, 44 pages.
Foreign Communication From a Counterpart Application, Chinese Application No. 201711011901.0, Chinese Office Action dated Sep. 3, 2019, 9 pages.

PRINTED DIPOLE ANTENNA, ARRAY ANTENNA, AND COMMUNICATIONS DEVICE

CROSS-REFERENCE TO RELATED APPLICATION

This application claims priority to Chinese Patent Application No. 201711011901.0 filed on Oct. 26, 2017, which is hereby incorporated by reference in its entirety.

TECHNICAL FIELD

This application relates to the field of wireless communications technologies, and in particular, to a printed dipole antenna, an array antenna, and a communications device.

BACKGROUND

A wireless local area network (WLAN) is widely applied to a home, an office, and another indoor/outdoor environment. In a high-density deployment scenario (for example, a stadium, where a height of an antenna above a ground is approximately 15 meters (m) to 50 m), there are many users per unit area, and a small-angle directional antenna needs to be used to reduce a coverage radius of a single access point device. A sidelobe suppression capability of the directional antenna determines a capability to suppress co-channel interference between adjacent access point devices in the high-density deployment scenario.

SUMMARY

This application is intended to reduce co-channel interference between adjacent access point devices in a high-density deployment scenario.

According to a first aspect, a printed dipole antenna is provided, where the printed dipole antenna includes a first printed dipole, a second printed dipole, a third printed dipole, a fourth printed dipole, a first feed line, a second feed line, a third feed line, and a fourth feed line. The first printed dipole is parallel to the second printed dipole, and is perpendicular to the first feed line, the first printed dipole is connected to one end of the first feed line, and the second printed dipole is connected to the other end of the first feed line. The third printed dipole is parallel to the fourth printed dipole, and is perpendicular to the second feed line, the third printed dipole is connected to one end of the second feed line, and the fourth printed dipole is connected to the other end of the second feed line. One end of the third feed line is connected to the first feed line, the other end of the third feed line is connected to one end of the fourth feed line, and the other end of the fourth feed line is connected to the second feed line.

The third feed line includes a first segment and a second segment, and the fourth feed line includes a third segment and a fourth segment. The first segment is parallel to the first printed dipole, and a distance from the first segment to the first printed dipole is less than a distance from a midpoint of the first feed line to the first printed dipole. The second segment is parallel to the second printed dipole, and a distance from the second segment to the second printed dipole is less than a distance from the midpoint of the first feed line to the second printed dipole. The third segment is parallel to the third printed dipole, and a distance from the third segment to the third printed dipole is less than a distance from a midpoint of the second feed line to the third printed dipole. The fourth segment is parallel to the fourth printed dipole, and a distance from the fourth segment to the fourth printed dipole is less than a distance from the midpoint of the second feed line to the fourth printed dipole.

The feed lines parallel to the printed dipoles each include different segments, and each segment approaches a printed dipole on one side of the segment, to suppress parasitic emission of the feed lines, and implement a low sidelobe level of the printed dipole antenna.

A distance from the first segment to the midpoint of the first feed line is 0.2 to 0.6 times a guide wavelength. A distance from the second segment to the midpoint of the first feed line is 0.2 to 0.6 times the guide wavelength. A distance from the third segment to the midpoint of the second feed line is 0.2 to 0.6 times the guide wavelength. A distance from the fourth segment to the midpoint of the second feed line is 0.2 to 0.6 times the guide wavelength. A length of the first segment is 0.1 to 0.3 times the guide wavelength. A length of the second segment is 0.1 to 0.3 times the guide wavelength. A length of the third segment is 0.1 to 0.3 times the guide wavelength. A length of the fourth segment is 0.1 to 0.3 times the guide wavelength.

The low sidelobe level of the printed dipole antenna is implemented within a 5 gigahertz (GHz) frequency band by setting the lengths of the first segment, the second segment, the third segment, and the fourth segment of the feed lines and the related distances.

One end of the first segment is connected to the first feed line using two feed lines, where the two feed lines include one feed line parallel to the first feed line and one feed line perpendicular to the first feed line, the other end of the first segment is connected to one end of the second segment using a feed line parallel to the first feed line, and the other end of the second segment is connected to the fourth feed line. One end of the third segment is connected to the second feed line using two feed lines, where the two feed lines include one feed line parallel to the second feed line and one feed line perpendicular to the second feed line, the other end of the third segment is connected to one end of the fourth segment using a feed line parallel to the second feed line, and the other end of the fourth segment is connected to the third feed line.

According to a second aspect, an array antenna is provided. In a first implementation of the second aspect, the array antenna includes a plurality of printed dipole antennas, and printed dipoles of any two adjacent printed dipole antennas of the plurality of printed dipole antennas are perpendicular to each other.

Printed dipoles of adjacent printed dipole antennas of the array antenna are perpendicular to each other, reducing parasitic emission between the adjacent printed dipole antennas, and implementing a low sidelobe level of the array antenna.

In a second implementation of the second aspect, the array antenna includes a plurality of printed dipole antennas, a fifth feed line, a sixth feed line, a seventh feed line, and an eighth feed line, where the plurality of printed dipole antennas include a first printed dipole antenna, a second printed dipole antenna, a third printed dipole antenna, and a fourth printed dipole antenna, and all printed dipoles of the plurality of printed dipole antennas are parallel. A printed dipole of the first printed dipole antenna is parallel to a printed dipole of the second printed dipole antenna, and is perpendicular to the fifth feed line, the first printed dipole antenna is connected to one end of the fifth feed line, and the second printed dipole antenna is connected to the other end of the fifth feed line. A printed dipole of the third printed dipole antenna is parallel to a printed dipole of the fourth printed dipole antenna, and is perpendicular to the sixth feed line, the third printed dipole antenna is connected to one end of the sixth feed line, and the fourth printed dipole antenna is connected to the other end of the sixth feed line. One end of the seventh feed line is connected to the fifth feed line, the other end of the seventh feed line is connected to one end of the eighth feed line, and the other end of the eighth feed line is connected to the sixth feed line.

The seventh feed line includes a fifth segment and a sixth segment, and the eighth feed line includes a seventh segment and an eighth segment. One end of the fifth segment is connected to the fifth feed line using two feed lines, where the two feed lines include one feed line parallel to the fifth feed line and one feed line perpendicular to the fifth feed line, the other end of the fifth segment is connected to one end of the sixth segment using a feed line parallel to the fifth feed line, and the other end of the sixth segment is connected to the eighth feed line. One end of the seventh segment is connected to the sixth feed line using two feed lines, where the two feed lines include one feed line parallel to the sixth feed line and one feed line perpendicular to the sixth feed line, the other end of the seventh segment is connected to one end of the eighth segment using a feed line parallel to the sixth feed line, and the other end of the eighth segment is connected to the seventh feed line. The fifth segment is parallel to the printed dipole of the first printed dipole antenna, and a distance from the fifth segment to the printed dipole of the first printed dipole antenna is less than a distance from a midpoint of the fifth feed line to the printed dipole of the first printed dipole antenna. The sixth segment is parallel to the printed dipole of the second printed dipole antenna, and a distance from the sixth segment to the printed dipole of the second printed dipole antenna is less than a distance from the midpoint of the fifth feed line to the printed dipole of the second printed dipole antenna. The seventh segment is parallel to the printed dipole of the third printed dipole antenna, and a distance from the seventh segment to the printed dipole of the third printed dipole antenna is less than a distance from a midpoint of the sixth feed line to the printed dipole of the third printed dipole antenna. The eighth segment is parallel to the printed dipole of the fourth printed dipole antenna, and a distance from the eighth segment to the printed dipole of the fourth printed dipole antenna is less than a distance from the midpoint of the sixth feed line to the printed dipole of the fourth printed dipole antenna.

Between the printed dipole antennas, the feed lines parallel to the printed dipoles of the printed dipole antennas each include different segments, and each segment approaches a printed dipole antenna on one side of the segment to suppress parasitic emission of the feed lines between the printed dipole antennas, and implement a low sidelobe level of the array antenna.

In a third implementation of the second aspect, the array antenna includes a plurality of array antennas in the second implementation of the second aspect. Printed dipoles of any two adjacent array antennas of the plurality of array antennas in the second implementation of the second aspect are perpendicular to each other.

Printed dipoles of adjacent printed dipole antennas of the array antenna are perpendicular to each other, reducing parasitic emission between the adjacent printed dipole antennas, and implementing a low sidelobe level of the array antenna.

According to a third aspect, a communications device is provided, where the communications device includes a radio frequency circuit and an antenna, the antenna is the printed dipole antenna provided in the first aspect or the array antenna provided in the second aspect, and the radio frequency circuit is configured to radiate and/or receive a signal using the antenna.

DESCRIPTION OF EMBODIMENTS

To make the objectives, technical solutions, and advantages of embodiments of the present disclosure clearer, the following further describes specific implementations of the embodiments of the present disclosure in detail with reference to the accompanying drawings.

Figure 1:
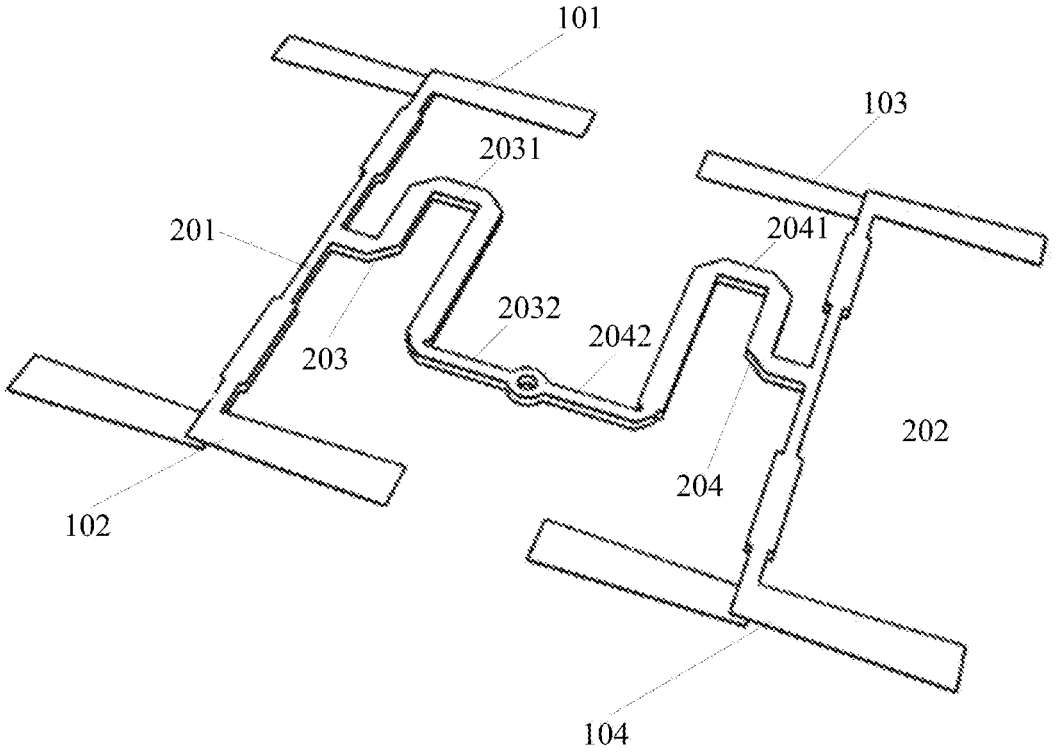
FIG. 1 is a schematic construction diagram of a printed dipole antenna according to an embodiment of the present disclosure.

FIG. 1 shows a printed dipole antenna according to an embodiment of the present disclosure. The printed dipole antenna includes a first printed dipole 101, a second printed dipole 102, a third printed dipole 103, a fourth printed dipole 104, a first feed line 201, a second feed line 202, a third feed line 203, and a fourth feed line 204. Two arms of any one of the first printed dipole 101, the second printed dipole 102, the third printed dipole 103, and the fourth printed dipole 104 are disposed on an upper surface and a lower surface of a dielectric substrate respectively, and extend towards opposite directions. Any one of the first feed line 201, the second feed line 202, the third feed line 203, and the fourth feed line 204 is disposed on the upper surface and the lower surface of the dielectric substrate. The first printed dipole 101 is parallel to the second printed dipole 102, and is perpendicular to the first feed line 201. The first printed dipole 101 is connected to one end of the first feed line 201, and the second printed dipole 102 is connected to the other end of the first feed line 201. The third printed dipole 103 is parallel to the fourth printed dipole 104, and is perpendicular to the second feed line 202. The third printed dipole 103 is connected to one end of the second feed line 202, and the fourth printed dipole 104 is connected to the other end of the second feed line 202. One end of the third feed line 203 is connected to the first feed line 201, and a connection point between the third feed line 203 and the first feed line 201 is any point on the first feed line 201 different from the two ends of the first feed line 201. The other end of the third feed line 203 is connected to one end of the fourth feed line 204, the other end of the fourth feed line 204 is connected to the second feed line 202, and a connection point between the fourth feed line 204 and the second feed line 202 is any point on the second feed line 202 different from the two ends of the second feed line 202.

In an example, the third feed line 203 includes a first segment 2031 and a second segment 2032, and the fourth feed line 204 includes a third segment 2041 and a fourth segment 2042. The first segment 2031 is parallel to the first printed dipole 101, and a distance from the first segment 2031 to the first printed dipole 101 is less than a distance from a midpoint of the first feed line 201 to the first printed dipole 101. The second segment 2032 is parallel to the second printed dipole 102, and a distance from the second segment 2032 to the second printed dipole 102 is less than a distance from the midpoint of the first feed line 201 to the second printed dipole 102. The third segment 2041 is parallel to the third printed dipole 103, and a distance from the third segment 2041 to the third printed dipole 103 is less than a distance from a midpoint of the second feed line 202 to the third printed dipole 103. The fourth segment 2042 is parallel to the fourth printed dipole 104, and a distance from the fourth segment 2042 to the fourth printed dipole 104 is less than a distance from the midpoint of the second feed line 202 to the fourth printed dipole 104.

The feed lines parallel to the printed dipoles each include different segments, and each segment approaches a printed dipole on one side of the segment to suppress parasitic emission of the feed lines, and implement a low sidelobe level of the printed dipole antenna.

In an example, a distance from the first segment 2031 to the midpoint of the first feed line 201 is 0.2 to 0.6 times a guide wavelength. A distance from the second segment 2032 to the midpoint of the first feed line 201 is 0.2 to 0.6 times the guide wavelength. A distance from the third segment 2041 to the midpoint of the second feed line 202 is 0.2 to 0.6 times the guide wavelength. A distance from the fourth segment 2042 to the midpoint of the second feed line 202 is 0.2 to 0.6 times the guide wavelength. A length of the first segment 2031 is 0.1 to 0.3 times the guide wavelength. A length of the second segment 2032 is 0.1 to 0.3 times the guide wavelength. A length of the third segment 2041 is 0.1 to 0.3 times the guide wavelength. A length of the fourth segment 2042 is 0.1 to 0.3 times the guide wavelength. The feed line is a double-sided parallel-strip line, and therefore the feed line is a waveguide. The guide wavelength is a wavelength of electromagnetic wave travelling along an axis of guided wave in the waveguide, that is, a guide wavelength of the feed line.

The low sidelobe level of the printed dipole antenna is implemented within a 5 GHz frequency band by setting the lengths of the first segment 2031, the second segment 2032, the third segment 2041, and the fourth segment 2042 of the feed lines and the related distances.

One end of the first segment 2031 is connected to the first feed line 201 using two feed lines, and the two feed lines include a feed line parallel to the first feed line 201 and a feed line perpendicular to the first feed line 201. The other end of the first segment 2031 is connected to one end of the second segment 2032 using a feed line parallel to the first feed line 201, and the other end of the second segment 2032 is connected to the fourth feed line 204. One end of the third segment 2041 is connected to the second feed line 202 using two feed lines, and the two feed lines include one feed line parallel to the second feed line 202 and one feed line perpendicular to the second feed line 202. The other end of the third segment 2041 is connected to one end of the fourth segment 2042 using a feed line parallel to the second feed line 202, and the other end of the fourth segment 2042 is connected to the third feed line 203.

According to the printed dipole antenna provided in this embodiment of the present disclosure, the feed lines parallel to the printed dipoles are optimized. If the optimized feed line design is applied to an array antenna, a plurality of the printed dipole antennas provided in this embodiment of the present disclosure may be used to form an array antenna.

Figure 2:
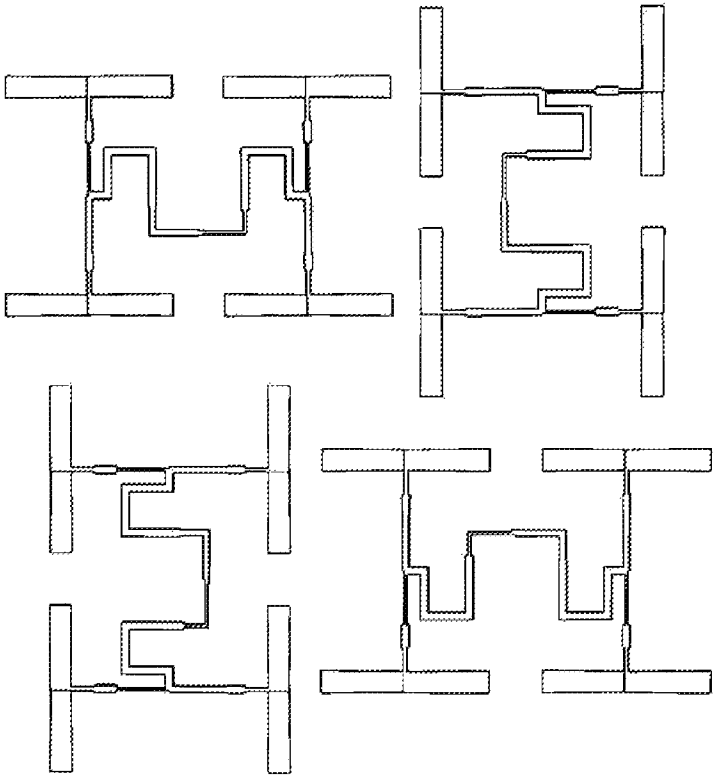
FIG. 2 is a schematic structural diagram of an array antenna according to Embodiment 1 of the present disclosure.

FIG. 2 is a schematic structural diagram of an array antenna according to Embodiment 1 of the present disclosure. The array antenna includes four printed dipole antennas, and printed dipoles of any two adjacent printed dipole antennas of the four printed dipole antennas are perpendicular to each other. Printed dipoles of adjacent printed dipole antennas of the array antenna are perpendicular to each other, reducing parasitic emission between the adjacent printed dipole antennas, and implementing a low sidelobe level of the array antenna.

Figure 3:
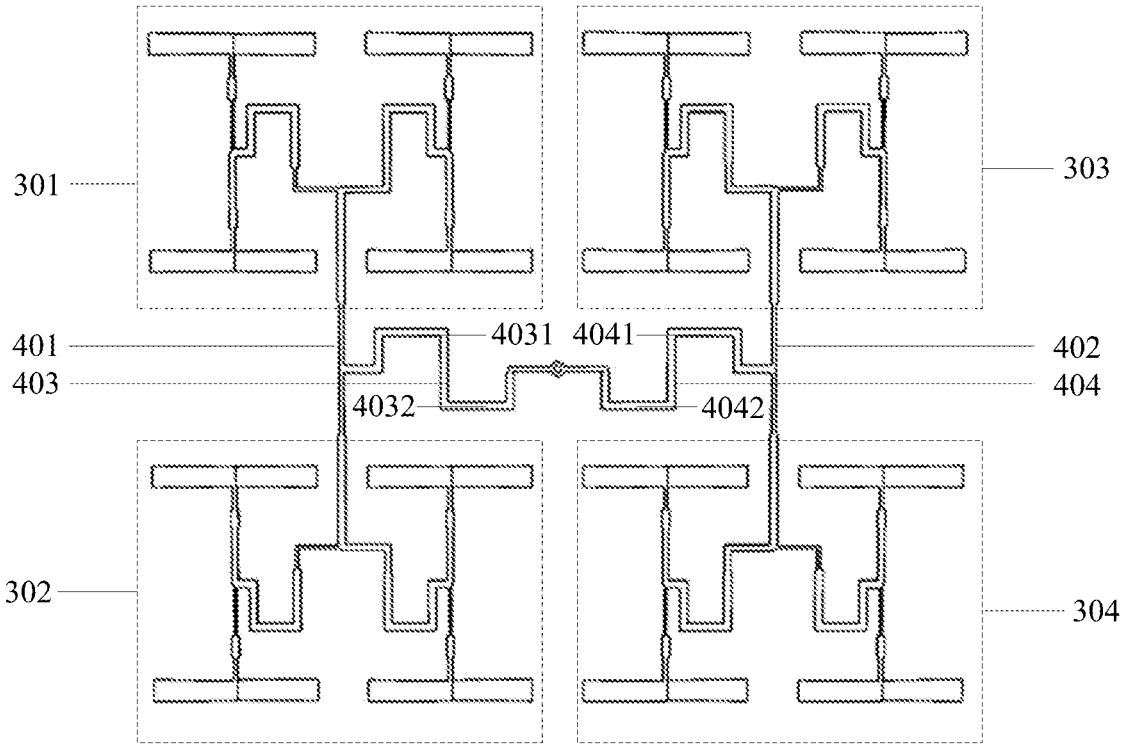
FIG. 3 is a schematic structural diagram of an array antenna according to Embodiment 2 of the present disclosure.

FIG. 3 is a schematic structural diagram of an array antenna according to Embodiment 2 of the present disclosure. The array antenna includes a first printed dipole antenna 301, a second printed dipole antenna 302, a third printed dipole antenna 303, a fourth printed dipole antenna 304, a fifth feed line 401, a sixth feed line 402, a seventh feed line 403, and an eighth feed line 404, and all printed dipoles of the four printed dipole antennas are parallel. A printed dipole of the first printed dipole antenna 301 is parallel to a printed dipole of the second printed dipole antenna 302, and is perpendicular to the fifth feed line 401. The first printed dipole antenna 301 is connected to one end of the fifth feed line 401, and the second printed dipole antenna 302 is connected to the other end of the fifth feed line 401. A printed dipole of the third printed dipole antenna 303 is parallel to a printed dipole of the fourth printed dipole antenna 304, and is perpendicular to the sixth feed line 402. The third printed dipole antenna 303 is connected to one end of the sixth feed line 402, and the fourth printed dipole antenna 304 is connected to the other end of the sixth feed line 402. One end of the seventh feed line 403 is connected to the fifth feed line 401, and a connection point between the seventh feed line 403 and the fifth feed line 401 is any point on the fifth feed line 401 different from the two ends of the fifth feed line 401. The other end of the seventh feed line 403 is connected to one end of the eighth feed line 404, the other end of the eighth feed line 404 is connected to the sixth feed line 402, and a connection point between the eighth feed line 404 and the sixth feed line 402 is any point on the sixth feed line 402 different from the two ends of the sixth feed line 402.

The seventh feed line 403 includes a fifth segment 4031 and a sixth segment 4032, and the eighth feed line 404 includes a seventh segment 4041 and an eighth segment 4042. One end of the fifth segment 4031 is connected to the fifth feed line 401 using two feed lines, and the two feed lines include one feed line parallel to the fifth feed line 401 and one feed line perpendicular to the fifth feed line 401. The other end of the fifth segment 4031 is connected to one end of the sixth segment 4032 using a feed line parallel to the fifth feed line 401, and the other end of the sixth segment 4032 is connected to the eighth feed line 404. One end of the seventh segment 4041 is connected to the sixth feed line 402 using two feed lines, and the two feed lines include one feed line parallel to the sixth feed line 402 and one feed line perpendicular to the sixth feed line 402. The other end of the seventh segment 4041 is connected to one end of the eighth segment 4042 using a feed line parallel to the sixth feed line 402, and the other end of the eighth segment 4042 is connected to the seventh feed line 403. The fifth segment 4031 is parallel to the printed dipole of the first printed dipole antenna 301, and a distance from the fifth segment 4031 to the printed dipole of the first printed dipole antenna 301 is less than a distance from a midpoint of the fifth feed line 401 to the printed dipole of the first printed dipole antenna 301. The sixth segment 4032 is parallel to the printed dipole of the second printed dipole antenna 302, and a distance from the sixth segment 4032 to the printed dipole of the second printed dipole antenna 302 is less than a distance from the midpoint of the fifth feed line 401 to the printed dipole of the second printed dipole antenna 302. The seventh segment 4041 is parallel to the printed dipole of the third printed dipole antenna 303, and a distance from the seventh segment 4041 to the printed dipole of the third printed dipole antenna 303 is less than a distance from a midpoint of the sixth feed line 402 to the printed dipole of the third printed dipole antenna 303. The eighth segment 4042 is parallel to the printed dipole of the fourth printed dipole antenna 304, and a distance from the eighth segment 4042 to the printed dipole of the fourth printed dipole antenna 304 is less than a distance from the midpoint of the sixth feed line 402 to the printed dipole of the fourth printed dipole antenna 304.

Between the printed dipole antennas, the feed lines parallel to the printed dipoles of the printed dipole antennas each include different segments, and each segment approaches a printed dipole antenna on one side of the segment, to suppress parasitic emission of the feed lines between the printed dipole antennas, and implement a low sidelobe level of the array antenna.

Figure 4:
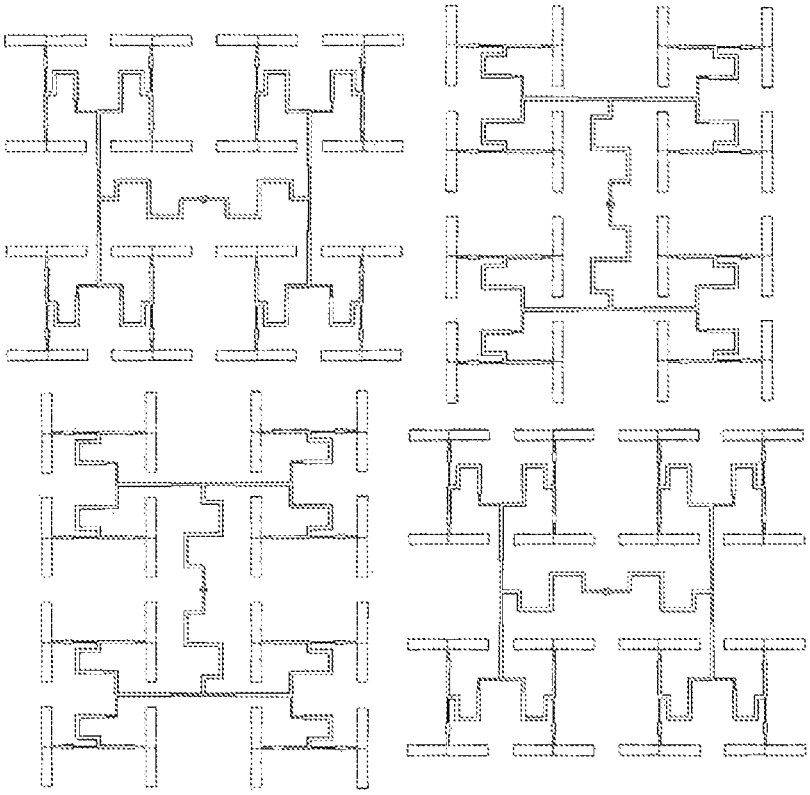
FIG. 4 is a schematic structural diagram of an array antenna according to Embodiment 3 of the present disclosure.

FIG. 4 is a schematic structural diagram of an array antenna according to Embodiment 3 of the present disclosure. The array antenna includes four array antennas shown in FIG. 3. Printed dipoles of any two adjacent array antennas of the four array antennas shown in FIG. 3 are perpendicular to each other.

Printed dipoles of adjacent printed dipole antennas of the array antenna are perpendicular to each other, reducing parasitic emission between the adjacent printed dipole antennas, and implementing a low sidelobe level of the array antenna.

Figure 5:
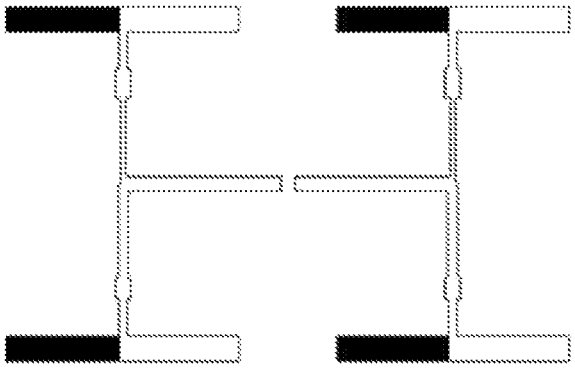
FIG. 5 is a schematic structural diagram of a 4×4 array antenna.
Figure 6:
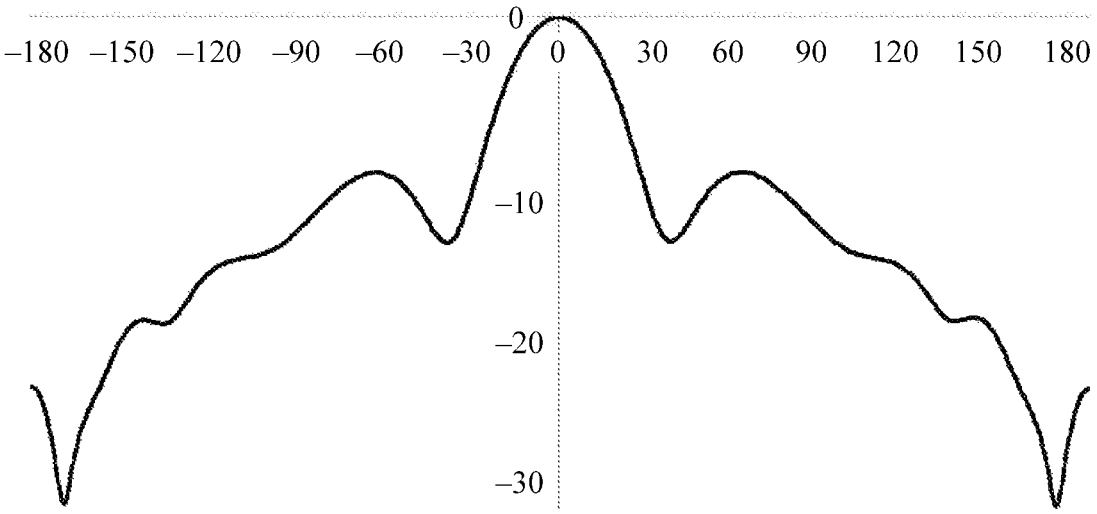
FIG. 6 is a simulation schematic diagram of a 4×4 array antenna.
Figure 7:
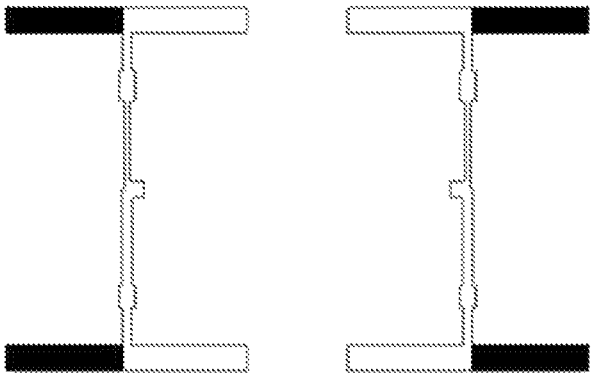
FIG. 7 is a schematic structural diagram of a 4×4 array antenna shielded from parasitic emission.
Figure 8:
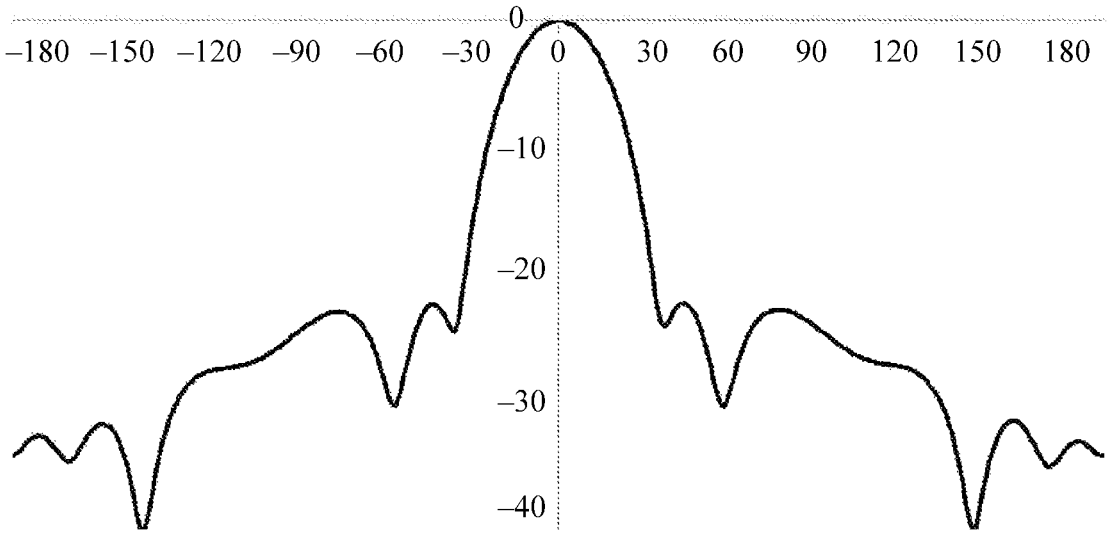
FIG. 8 is a simulation schematic diagram of a 4×4 array antenna shielded from parasitic emission.
Figure 9:
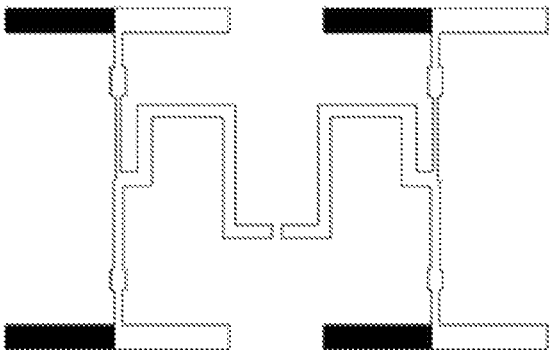
FIG. 9 is a schematic structural diagram of a 4×4 array antenna according to an embodiment of the present disclosure.
Figure 10:
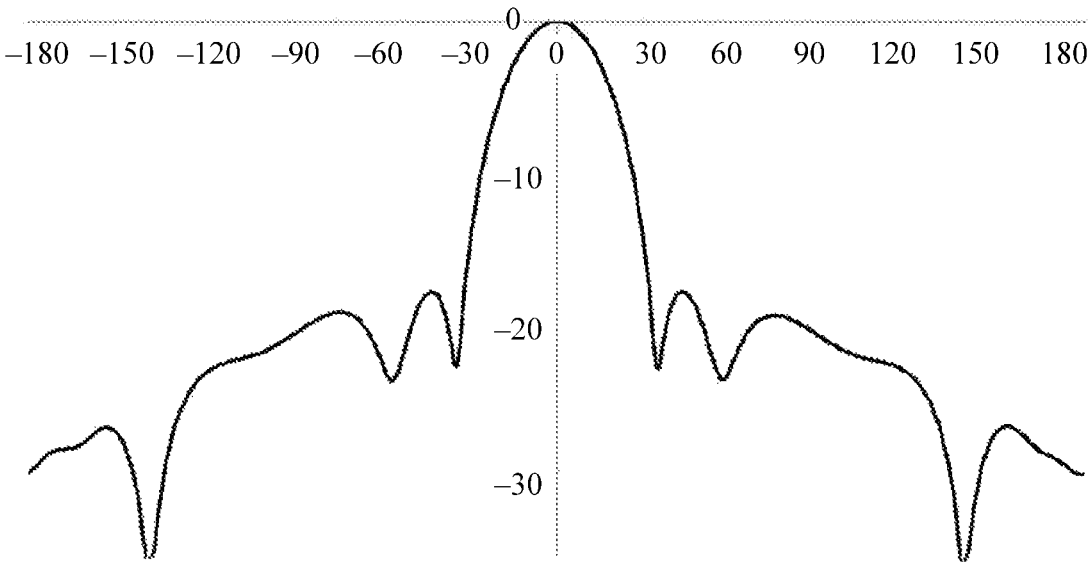
FIG. 10 is a simulation schematic diagram of a 4×4 array antenna according to an embodiment of the present disclosure.

FIG. 5 is a schematic structural diagram of a 4×4 array antenna. Correspondingly, FIG. 6 is a simulation schematic diagram of radiation of the array antenna shown in FIG. 5. It can be seen that a test result of the array antenna shown in FIG. 5 is that a sidelobe level is less than −9 decibel (dB). FIG. 7 is a schematic structural diagram of a 4×4 array antenna obtained after feed lines parallel to printed dipole antennas of the array antenna shown in FIG. 5 are shielded. For example, a reflection panel may be used to isolate the feed lines parallel to printed dipoles. FIG. 8 is a simulation schematic diagram of radiation of the array antenna shown in FIG. 7. It can be seen that a test result of the array antenna shown in FIG. 7 is that a sidelobe level is less than −21 dB. FIG. 9 is a schematic structural diagram of a printed dipole antenna according to an embodiment of the present disclosure. FIG. 10 is a simulation schematic diagram of radiation of the array antenna shown in FIG. 9. It can be seen that a test result of the printed dipole antenna using the structure in this embodiment of the present disclosure is that a sidelobe level is less than −19 dB. Based on comparison between the test results, the array antenna provided in this application reduces parasitic emission of feed lines and between printed dipole antennas, and a low sidelobe level of the array antenna can be implemented.

Figure 11:
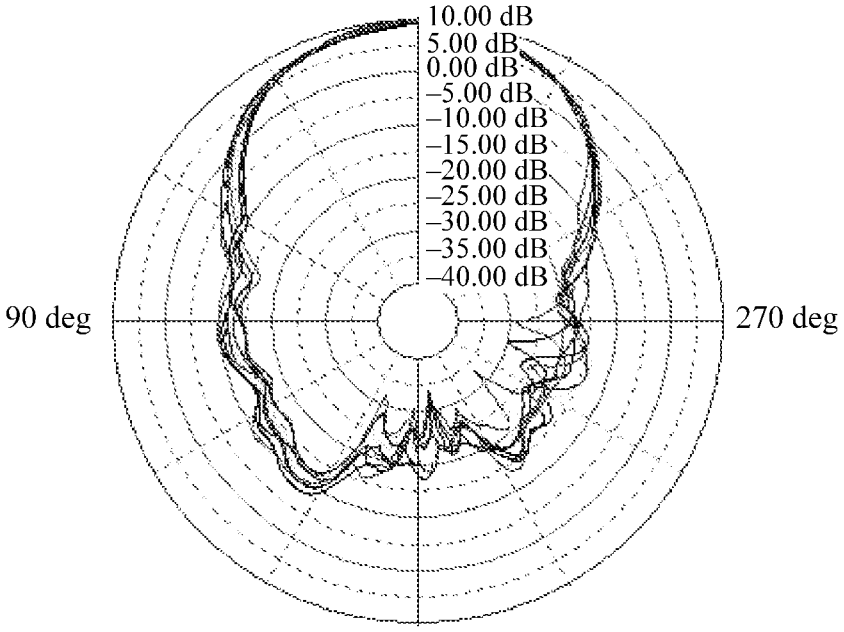
FIG. 11 is a schematic diagram of test data of a 2×2 array antenna according to an embodiment of the present disclosure.

FIG. 11 is a schematic diagram of test data of a 2×2 array antenna according to an embodiment of the present disclosure. In FIG. 11, lines represent data line graphs generated at different frequencies in a frequency band ranging from 5150 megahertz (MHz) to 5850 MHz. In an embodiment, a test result of a test performed on the 2×2 array antenna provided in this embodiment of the present disclosure is that a sidelobe level is less than −18 dB.

Figure 12:
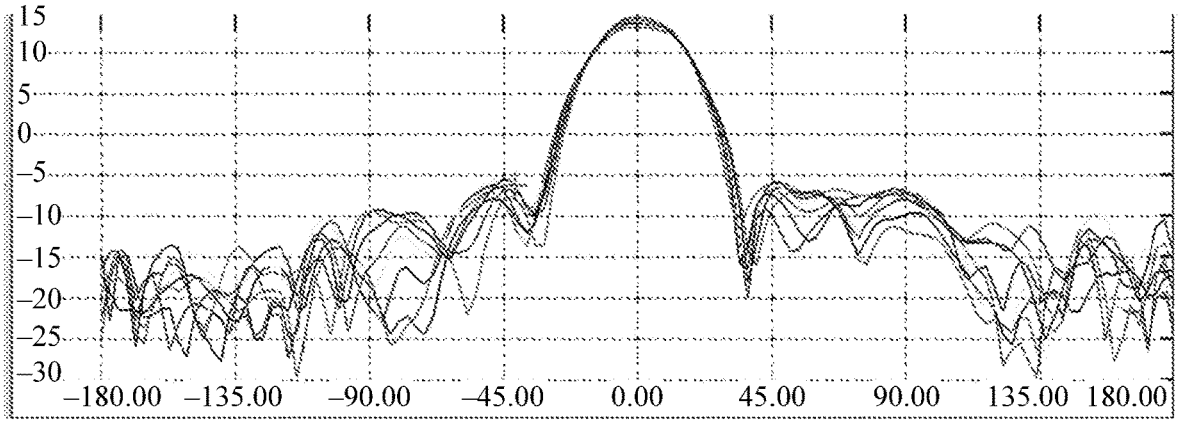
FIG. 12 is a schematic diagram of test data of a 4×4 array antenna according to an embodiment of the present disclosure.

FIG. 12 is a schematic diagram of test data of a 4×4 array antenna according to an embodiment of the present disclosure. In FIG. 12, lines represent data line graphs generated at different frequencies in a frequency band ranging from 5150 MHz to 5850 MHz. In an embodiment, a test result of a test performed on the 4×4 array antenna provided in this embodiment of the present disclosure is that a sidelobe level is less than −16 dB. Because of a measurement error in sidelobe measurement by a measuring system and a processing error, FIG. 12 is not completely the same as the simulation diagram shown in FIG. 10.

Figure 13:
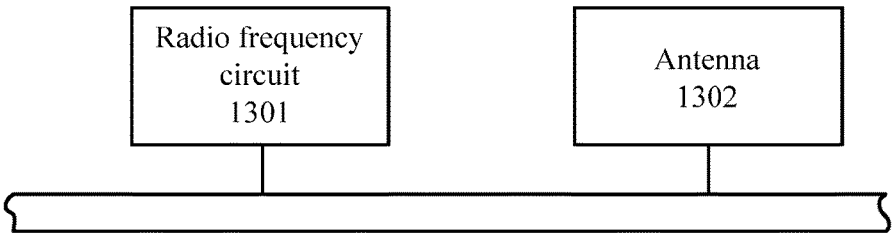
FIG. 13 shows a communications device according to an embodiment of the present disclosure.

FIG. 13 shows a communications device according to an embodiment of the present disclosure. The communications device is a wireless access point (AP) or a communications device that radiates/receives a signal using an array antenna. The communications device includes a radio frequency circuit 1301 and an antenna 1302. The antenna 1302 is a printed dipole antenna or an array antenna, and the radio frequency circuit 1301 is configured to radiate and/or receive a signal using the antenna 1302.

A quantity of array elements is not limited in the array antenna provided in the embodiments of the present disclosure. The test proves that according to the array antenna provided in this application, a low-sidelobe-level design of a 2×2 or 4×4 array antenna can be implemented. An average sidelobe level in an array pattern is less than −16 dB. This proves that the array antenna provided in this application can suppress a level of the parasitic radiation generated by the printed dipole antennas and the feed lines to be less than the sidelobe level of −16 dB.

The foregoing descriptions are merely specific implementations of the present disclosure, but are not intended to limit the protection scope of the present disclosure. Any variation or replacement readily figured out by a person skilled in the art within the technical scope disclosed in the present disclosure shall fall within the protection scope of the present disclosure. Therefore, the protection scope of the present disclosure shall be subject to the protection scope of the claims.

What is claimed is:

1. A printed dipole antenna, comprising:

a first feed line;

a first printed dipole coupled to one end of the first feed line, the first printed dipole being parallel to a second printed dipole and perpendicular to the first feed line;

the second printed dipole coupled to the other end of the first feed line;

a second feed line;

a third printed dipole coupled to one end of the second feed line, the third printed dipole being parallel to a fourth printed dipole and perpendicular to the second feed line;

the fourth printed dipole coupled to the other end of the second feed line;

a third feed line, one end of the third feed line being coupled to the first feed line, the other end of the third feed line being coupled to one end of a fourth feed line, the third feed line comprising a first segment and a second segment, the first segment being parallel to the first printed dipole, a distance from the first segment to the first printed dipole being less than a distance from a midpoint of the first feed line to the first printed dipole, the second segment being parallel to the second printed dipole, and a distance from the second segment to the second printed dipole being less than a distance from the midpoint of the first feed line to the second printed dipole; and the fourth feed line, the other end of the fourth feed line being coupled to the second feed line, the fourth feed line comprising a third segment and a fourth segment, the third segment being parallel to the third printed dipole, a distance from the third segment to the third printed dipole being less than a distance from a midpoint of the second feed line to the third printed dipole, the fourth segment being parallel to the fourth printed dipole, and a distance from the fourth segment to the fourth printed dipole being less than a distance from the midpoint of the second feed line to the fourth printed dipole.

2. The printed dipole antenna of claim 1, wherein a distance from the first segment to the midpoint of the first feed line is from 0.2 to 0.6 times a guide wavelength.

3. The printed dipole antenna of claim 1, wherein a distance from the second segment to the midpoint of the first feed line is from 0.2 to 0.6 times a guide wavelength.

4. The printed dipole antenna of claim 1, wherein a distance from the third segment to the midpoint of the second feed line is from 0.2 to 0.6 times a guide wavelength.

5. The printed dipole antenna of claim 1, wherein a distance from the fourth segment to the midpoint of the second feed line is from 0.2 to 0.6 times a guide wavelength.

6. The printed dipole antenna of claim 1, wherein a length of the first segment is from 0.1 to 0.3 times a guide wavelength, a length of the second segment being from 0.1 to 0.3 times the guide wavelength, a length of the third segment being from 0.1 to 0.3 times the guide wavelength, and a length of the fourth segment being from 0.1 to 0.3 times the guide wavelength.

7. The printed dipole antenna of claim 1, wherein one end of the first segment is coupled to the first feed line using two feed lines, the two feed lines comprising one feed line parallel to the first feed line and one feed line perpendicular to the first feed line, the other end of the first segment being coupled to one end of the second segment using a fifth feed line parallel to the first feed line, and the other end of the second segment being to the fourth feed line, one end of the third segment being coupled to the second feed line using another two feed lines, the other two feed lines comprising one feed line parallel to the second feed line and one feed line perpendicular to the second feed line, the other end of the third segment being coupled to one end of the fourth segment using a sixth feed line parallel to the second feed line, and the other end of the fourth segment being coupled to the third feed line.

8. An array antenna, comprising:

a plurality of printed dipole antennas, each printed dipole antenna comprising:

a first feed line;

a first printed dipole coupled to one end of the first feed line, the first printed dipole being parallel to a second printed dipole and perpendicular to the first feed line;

the second printed dipole coupled to the other end of the first feed line;

a second feed line;

a third printed dipole coupled to one end of the second feed line, the third printed dipole being parallel to fourth printed dipole and perpendicular to the second feed line;

the fourth printed dipole coupled to the other end of the second feed line;

a third feed line, one end of the third feed line being coupled to the first feed line, the other end of the third feed line being coupled to one end of a fourth feed line, the third feed line comprising a first segment and a second segment, the first segment being parallel to the first printed dipole, a distance from the first segment to the first printed dipole being less than a distance from a midpoint of the first feed line to the first printed dipole, the second segment being parallel to the second printed dipole, and, a distance from the second segment to the second printed dipole being less than a distance from the midpoint of the first feed line to the second printed dipole; and the fourth feed line, the other end of the fourth feed line being coupled to the second feed line, the fourth feed line comprising a third segment and a fourth segment, the third segment being parallel to the third printed dipole, a distance from the third segment to the third printed dipole being less than a distance from a midpoint of the second feed line to the third printed dipole, the fourth segment being parallel to the fourth printed dipole, and a distance from the fourth segment to the fourth printed dipole being less than a distance from the midpoint of the second feed line to the fourth printed dipole, and printed dipoles of any two adjacent printed dipole antennas of the printed dipole antennas being perpendicular to each other.

9. A communications device, comprising:

an antenna comprising:

a first feed line;

a first printed dipole coupled to one end of the first feed line, the first printed dipole being parallel to a second printed dipole and perpendicular to the first feed line;

the second printed dipole coupled to the other end of the first feed line;

a second feed line;

a third printed dipole coupled to one end of the second feed line, the third printed dipole being parallel to a fourth printed dipole and perpendicular to the second feed line;

the fourth printed dipole coupled to the other end of the second feed line;

a third feed line, one end of the third feed line being coupled to the first feed line, the other end of the third feed line being coupled to one end of a fourth feed line the third feed line comprising a first segment and a second segment, the first segment being dipole being less than a distance from a midpoint of the first feed line to the first printed dipole, the second segment being parallel to the second printed dipole, and a distance from the second segment to the second printed dipole being less than a distance from the midpoint of the first feed line to the second printed dipole; and the fourth feed line, the other end of the fourth feed line being coupled to the second feed line, the fourth feed line comprising a third segment and a fourth segment, the third segment being parallel to the third printed dipole, a distance from the third segment to the third printed dipole being less than a distance from a midpoint of the second feed line to the third printed dipole, the fourth segment being parallel to the fourth printed dipole, and a distance from the fourth segment to the fourth printed dipole being less than a distance from the midpoint of the second feed line to the fourth printed dipole, a radio frequency circuit coupled to the antenna and configured to radiate signals and receive signals using the antenna.

10. The array antenna of claim 8, wherein a distance from the first segment to the midpoint of the first feed line is from 0.2 to 0.6 times a guide wavelength.

11. The array antenna of claim 8, wherein a distance from the second segment to the midpoint of the first feed line is from 0.2 to 0.6 times a guide wavelength.

12. The array antenna of claim 8, wherein a distance from the third segment to the midpoint of the second feed line is from 0.2 to 0.6 times a guide wavelength.

13. The array antenna of claim 8, wherein a distance from the fourth segment to the midpoint of the second feed line is from 0.2 to 0.6 times a guide wavelength.

14. The array antenna of claim 8, wherein a length of the first segment is from 0.1 to 0.3 times a guide wavelength, a length of the second segment being from 0.1 to 0.3 times the guide wavelength, a length of the third segment being from 0.1 to 0.3 times the guide wavelength, and a length of the fourth segment being from 0.1 to 0.3 times the guide wavelength.

15. The array antenna of claim 8, wherein one end of the first segment is coupled to the first feed line using two feed lines, the two feed lines comprising one feed line parallel to the first feed line and one feed line perpendicular to the first feed line, the other end of the first segment being coupled to one end of the second segment using a fifth feed line parallel to the first feed line, and the other end of the second segment being coupled to the fourth feed line, one end of the third segment being coupled to the second feed line using another two feed lines, the other two feed lines comprising one feed line parallel to the second feed line and one feed line perpendicular to the second feed line, the other end of the third segment being coupled to one end of the fourth segment using a sixth feed line parallel to the second feed line, and the other end of the fourth segment being coupled to the third feed line.

16. The communications device of claim 9, wherein a distance from the first segment to the midpoint of the first feed line is from 0.2 to 0.6 times a guide wavelength, and a distance from the second segment to the midpoint of the first feed line is from 0.2 to 0.6 times the guide wavelength.

17. The communications device of claim 9, wherein a distance from the third segment to the midpoint of the second feed line is from 0.2 to 0.6 times a guide wavelength.

18. The communications device of claim 9, wherein a distance from the fourth segment to the midpoint of the second feed line is from 0.2 to 0.6 times a guide wavelength.

19. The communications device of claim 9, wherein a length of the first segment is from 0.1 to 0.3 times a guide wavelength, a length of the second segment being from 0.1 to 0.3 times the guide wavelength, a length of the third segment being from 0.1 to 0.3 times the guide wavelength, and a length of the fourth segment being from 0.1 to 0.3 times the guide wavelength.

20. The communications device of claim 9, wherein one end of the first segment is coupled to the first feed line using two feed lines, the two feed lines comprising one feed line parallel to the first feed line and one feed line perpendicular to the first feed line, the other end of the first segment being coupled to one end of the second segment using a fifth feed line parallel to the first feed line, and the other end of the second segment being coupled to the fourth feed line, one end of the third segment being coupled to the second feed line using another two feed lines, the other two feed lines comprising one feed line parallel to the second feed line and one feed line perpendicular to the second feed line, the other end of the third segment being coupled to one end of the fourth segment using a sixth feed line parallel to the second feed line, and the other end of the fourth segment being coupled to the third feed line.

* * * * *